US011619108B2

(12) United States Patent
Clemens et al.

(10) Patent No.: US 11,619,108 B2
(45) Date of Patent: Apr. 4, 2023

(54) BRIDGE PLUGS WITH BARRIER SLEEVES

(71) Applicant: Halliburton Energy Services, Inc., Houston, TX (US)

(72) Inventors: Jack Gammill Clemens, Fairview, TX (US); Anthony Phan, Lewisville, TX (US); Mark Holly, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 410 days.

(21) Appl. No.: 16/485,863

(22) PCT Filed: Sep. 19, 2018

(86) PCT No.: PCT/US2018/051780

§ 371 (c)(1),
(2) Date: Aug. 14, 2019

(87) PCT Pub. No.: WO2020/060548

PCT Pub. Date: Mar. 26, 2020

(65) Prior Publication Data

US 2021/0332663 A1 Oct. 28, 2021

(51) Int. Cl.
*E21B 33/134* (2006.01)
*E21B 33/128* (2006.01)
*E21B 33/12* (2006.01)

(52) U.S. Cl.
CPC ..... *E21B 33/134* (2013.01); *E21B 33/128* (2013.01); *E21B 33/1208* (2013.01)

(58) Field of Classification Search
CPC ..... E21B 33/134; E21B 33/136
See application file for complete search history.

(56) References Cited

U.S. PATENT DOCUMENTS 2,710,065 A * 6/1955 Hamilton, Jr. ..... E21B 33/136 166/117
3,891,034 A 6/1975 Owen et al.
(Continued)

FOREIGN PATENT DOCUMENTS

| | | | |
|---|---|---|---|
| CN | 106068364 | A | 11/2016 |
| EP | 3090124 | A2 | 11/2016 |
| WO | 2010115188 | A2 | 10/2010 |

OTHER PUBLICATIONS

International Search Report and Written Opinion for PCT application No. PCT/US2018/051780 dated Jun. 7, 2018, 12 pages.

*Primary Examiner* — Cathleen R Hutchins
(74) *Attorney, Agent, or Firm* — John Wustenberg; Parker Justiss, P.C.

(57) ABSTRACT

A bridge plug includes a splayable assembly. The splayable assembly includes an upper annulus with upper extensions, a lower annulus with lower extensions opposing the upper annulus along an axis extending through the upper annulus and the lower annulus, and a linkage connecting the lower annulus to the upper annulus. The linkage has an upper link pivotably connected to a lower link, the upper link pivotably connected between circumferentially adjacent upper extensions and the lower link pivotably connected between circumferentially adjacent lower extensions. The elastic barrier sleeve extends circumferentially about the splayable assembly such that movement of the lower annulus towards the upper annulus expands the elastic barrier sleeve to form a barrier within a wellbore. Bridge plug arrangements and methods of emplacing bridge plugs in wellbores are also described.

20 Claims, 6 Drawing Sheets

(56) References Cited

U.S. PATENT DOCUMENTS

| | | | | |
|---|---|---|---|---|
| 6,234,249 | B1 | 5/2001 | Andersen et al. | |
| 9,051,812 | B2 | 6/2015 | Clemens et al. | |
| 2004/0194969 | A1 | 10/2004 | Hiorth et al. | |
| 2011/0073326 | A1* | 3/2011 | Clemens | E21B 23/01 166/382 |
| 2011/0086942 | A1* | 4/2011 | Robisson | C09K 8/44 523/130 |
| 2013/0206410 | A1 | 8/2013 | Guerrero | |
| 2015/0152704 | A1 | 6/2015 | Tunget | |
| 2015/0275618 | A1 | 10/2015 | Clemens et al. | |
| 2019/0010780 | A1* | 1/2019 | Clemens | E21B 33/129 |

* cited by examiner

BRIDGE PLUGS WITH BARRIER SLEEVES

BACKGROUND OF THE INVENTION

1. Field of the Invention

The present disclosure relates to bridge plugs, and more particularly to through-tubing bridge plugs having elastic barrier sleeves for oil and gas wells.

2. Description of Related Art

Wellbores, such as in oil and gas wells, are commonly drilled into subterranean formations to extract fluids from the formation. In some wellbores it can be necessary to isolate an upper portion of the wellbore from a lower portion of the wellbore, for example using a barrier plug, to control fluid flow within the wellbore. The barrier plug is generally conveyed into the wellbore via a production tube to a desired location, where the barrier plug is fixed within the wellbore. Conveyance is generally via a cable, such as an electric line (e-line) cable.

E-line arrangements generally employ an armored electrical cable that cooperates with the barrier plug structure to both convey the barrier plug into the well and fix the barrier plug within the wellbore once suitably positioned. In this respect e-line cables typically have an electrical conductor sheathed in an insulator or armored insulator with steel wires wrapped thereabout. The steel wires provide tensile strength to support both the weight of the barrier plug and the cable while the conductor provides electrical communication with the barrier plug for fixation within the wellbore. The functionality provided by the e-line cable can offset the weight and size of the e-line cable in comparison to other cable arrangements, like slicklines.

Such conventional methods and systems have generally been considered satisfactory for their intended purpose. However, there is still a need in the art for improved for bridge plugs, slickline arrangements, and methods of placing bridge plugs within wellbores. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
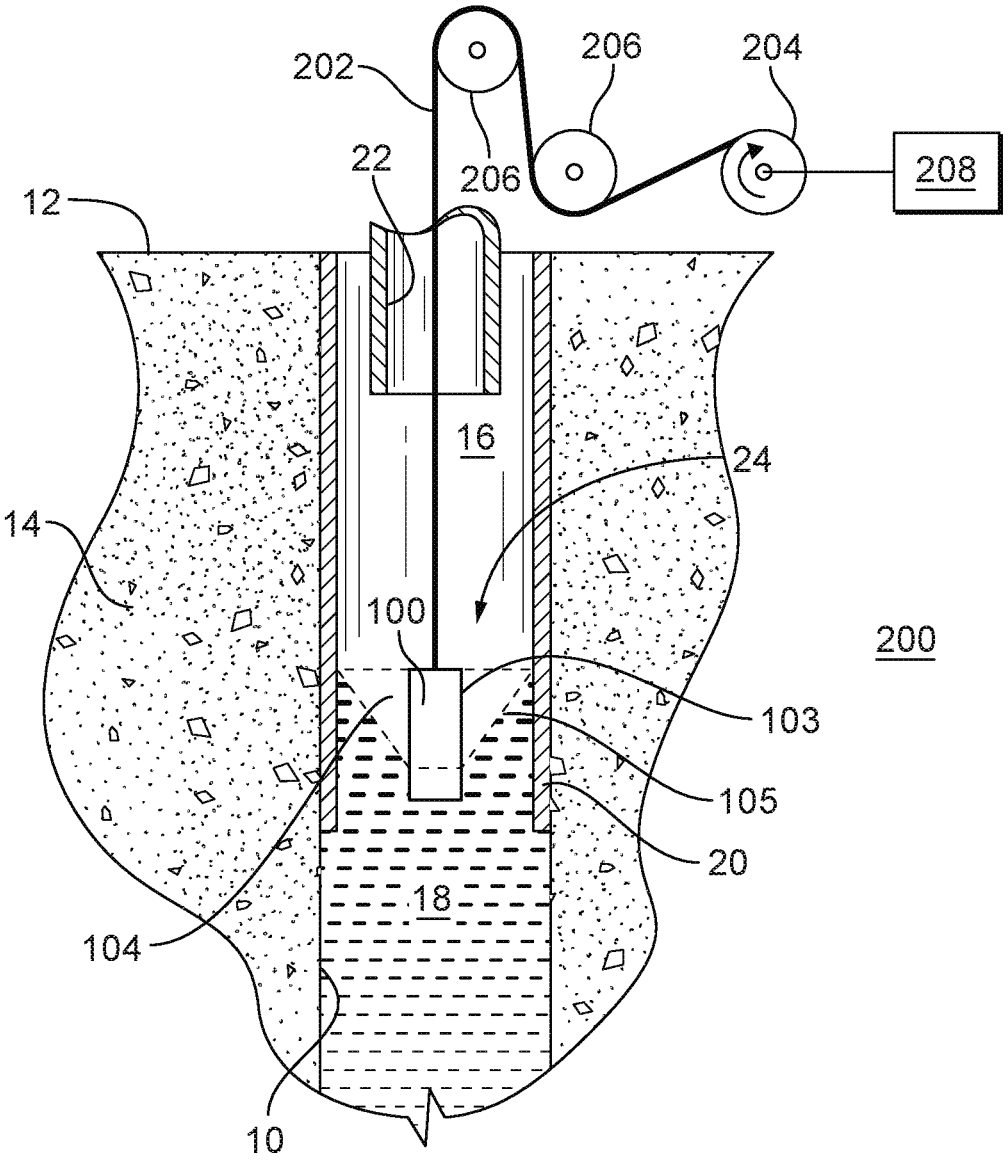
FIG. 1 is a schematic view of a slickline arrangement constructed in accordance with the present disclosure, showing a through-tubing bridge plug including a splaying assembly with an elastic barrier sleeve wrapped thereabout suspended within a wellbore by a slickline, the elastic barrier sleeve radially compressible against the wellbore casing by the splaying assembly.

Reference will now be made to the drawings wherein like reference numerals identify similar structural features or aspects of the subject disclosure. For purposes of explanation and illustration, and not limitation, a partial view of an exemplary embodiment of a through-tubing bridge plug in accordance with the disclosure is shown in FIG. 1 and is designated generally by reference character 100. Other embodiments of through-tubing bridge plugs, through-tubing bridge plug arrangements, and methods of placing through-tubing bridge plugs in wellbores in accordance with the disclosure, or aspects thereof, are provided in FIGS. 2-6, as will be described. The systems and methods described herein can be used for controlling fluid flow within wellbores, such as in oil and gas wells, though the present disclosure is not limited to oil and gas wells or to flow control within wellbores in general.

Referring to FIG. 1, a slickline arrangement 200 is shown. Slickline arrangement includes a slickline 202, a slickline reel or drum 204, one or more slickline sheaves 206 and a bridge plug 100. Bridge plug 100 is disposed within a wellbore 10. Wellbore 10 extends from surface 12 and into a subterranean formation 14, e.g., an oil and/or gas-containing subterranean formation 14, and has an upper portion 16 and a lower portion 18. Lower portion 18 is located fluidly upstream of upper portion 16 relative to a direction of fluid flow from wellbore 10 to surface 12. A casing 20 is cemented in place along at least a portion of wellbore 10. Tubing 22, e.g., production tubing, is hung within casing 20 and extends along a portion of wellbore 10.

Slickline arrangement 200 is configured to place bridge plug 100 within wellbore 10 using slickline 202. In this respect slickline 202 extends between bridge plug 100 and slickline reel or drum 204 across the one or more slickline sheaves 206. Slickline sheaves 206 direct slickline 202 between slickline reel or drum 204 to wellbore 10 for positioning within wellbore 10, such as when lowered into wellbore 10 and positioned between upper portion 16 and lower portion 18 of wellbore 10. It is contemplated that slickline 202 can include a single strand of wire configured to convey (run) bridge plug 100 into wellbore 10, slickline 202 being fed from slickline reel or drum 204 via a drive 208 operably connected to slickline reel or drum 204.

Bridge plug 100 includes a splayable assembly 101 (shown in FIG. 4) with a generally cylindrical shape 103 and an elastic barrier sleeve 104, which extends about splayable assembly 101. The splayable assembly 101 has an upper annulus 110 (shown in FIG. 2) and a lower annulus 112 (shown in FIG. 2) coupled to on another by a plurality of linkages 102 (shown in FIG. 3), the lower annulus 112 movable relative to upper annulus 110 between a distal position 106 (shown in FIG. 2) and a distal position 108 (shown in FIG. 3) for compressing elastic barrier sleeve 104 between splayable assembly 101 and an interior surface of casing 20. The terms upper and lower and used in connection with splayable assembly 101 are in relation to structures as illustrated in the drawing figures. As will be appreciated by those of skill in the art in view of the present disclosure, lower annulus 112 can be between upper annulus 110 and surface 12 and remain within the scope of the present disclosure.

Displacement of lower annulus 112 (shown in FIG. 2) between distal position 106 (shown in FIG. 2) and proximate position 108 (shown in FIG. 3) deforms elastic barrier sleeve 104. The deformation changes the shape of elastic barrier sleeve 104, shape changing in the illustrated exemplary embodiment between a generally cylindrical shape 103 to a frusto-conical shape 105 upon movement of lower annulus 112 between distal position 106 and proximate position 108. As will be appreciated by those of skill in the art in view of the present disclosure, changing the shape of elastic barrier sleeve 104 to frusto-conical shape 105 compresses elastic barrier sleeve 104 between splayable assembly 101 and the interior surface of casing 20, thereby forming a separation/isolation barrier 24. Separation/isolation barrier 24, via compression of elastic barrier sleeve 104 between splayable assembly 101 and the interior surface of casing 20, fluidly separates (or isolates entirely) lower portion 18 of wellbore 10 from upper portion 16 of wellbore 10, thereby providing fluid flow control within wellbore 10. As will also be appreciated by those of skill in the art in view of the present disclosure, although shown in FIG. 1 as a through-tubing bridge plug, bridge plugs and other barrier devices configured for deployment into wellbores without production tubing can also benefit from the present disclosure.

Figure 2:
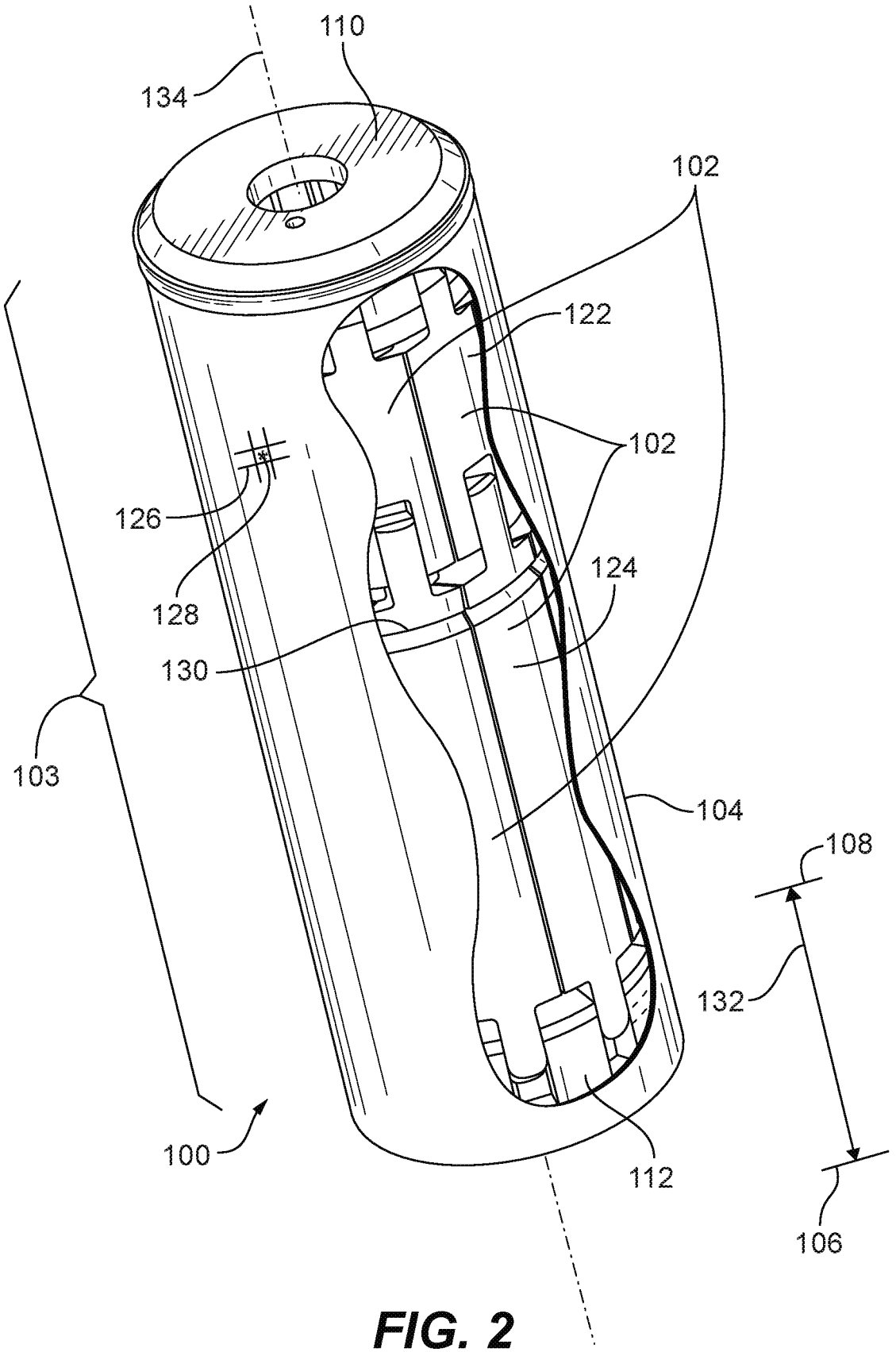
FIG. 2 is a side elevation view of the through-tubing bridge plug of FIG. 1, showing the elastic barrier sleeve having a cylindrical shape when the lower annulus is positioned distally relative to an upper annulus of the through-tubing bridge plug.
Figure 3:
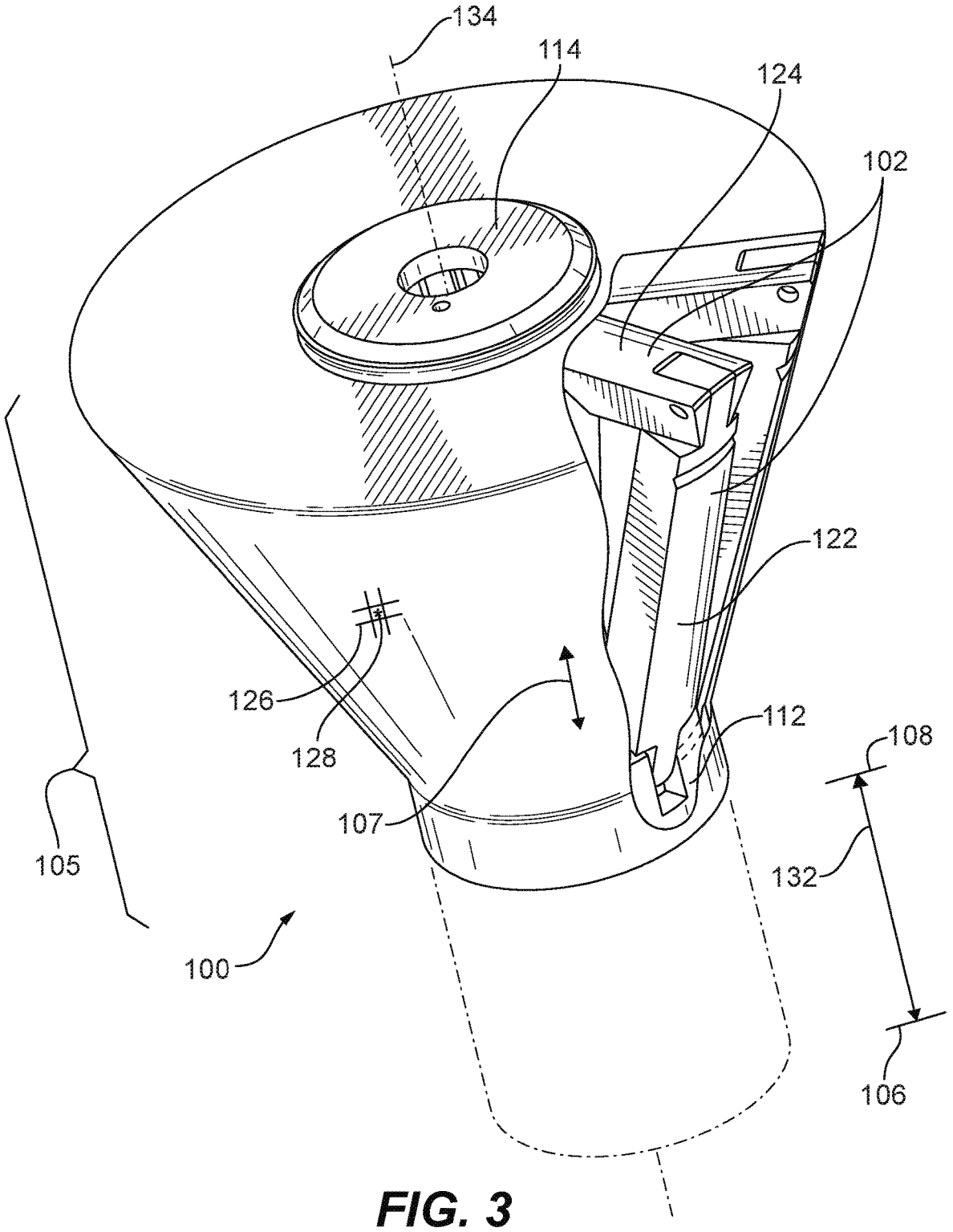
FIG. 3 is a side elevation the elastic barrier sleeve of the through-tubing bridge plug of FIG. 1, showing the elastic sleeve assuming a frusto-conical shape when the lower annulus is displaced to a proximate position relative to the upper annulus of the through-tubing bridge plug.

With reference to FIGS. 2 and 3, bridge plug 100 is shown with lower annulus 112 disposed at distal position 106 and proximate position 108. As shown in FIG. 2, when lower annulus 112 is disposed at distal position 106, bridge plug 100 has an elongated shape and elastic barrier sleeve 104 assumes generally cylindrical shape 103. As shown in FIG. 3, when lower annulus 112 moves from distal position 106 to proximate position 108, bridge plug 100 axially shortens and radially widens, elastic barrier sleeve 104 thereby widening as it changes between cylindrical shape 103 (shown in FIG. 1) and frusto-conical shape 105.

It is contemplated that the displacement between distal position 106 and proximate position 108, i.e., the stroke 132 of lower annulus 112, be relatively small, simplifying construction of bridge plug 100. In certain embodiments stroke 132 can be on the order of about nine (9) inches (about 23 centimeters), which provides suitable closure compression for common diameter wellbore casing sizes and compact construction of bridge plug 100. It is also contemplated that the movement of lower annulus 112 from distal position 106 to proximate position 108 can load elastic barrier sleeve 104 in with tension 107, which is generally directed axially along axis 134.

Elastic sleeve 104 extends circumferentially about at least a portion of splayable assembly 101 and includes a matrix 126. Matrix 126 provides strength to elastic sleeve 104. Matrix 126 is impregnated with an elastomeric material 128, which is supported by matrix 126 and which prevents movement of fluid through elastic sleeve 104. Examples of suitable materials for matrix 126 include fiberglass, cotton cloth, nylon and Teflon. Examples of suitable elastomeric materials nitrile rubbers, such as hydrogenated nitrile butadiene rubber (HNBR), and fluorinated elastomers such perfluoroelastomers (FFKM). As will be appreciated by those of skill in the art, materials such as these are suitable for the generally hostile temperatures and chemistries that can be found within wellbores.

Figure 4:
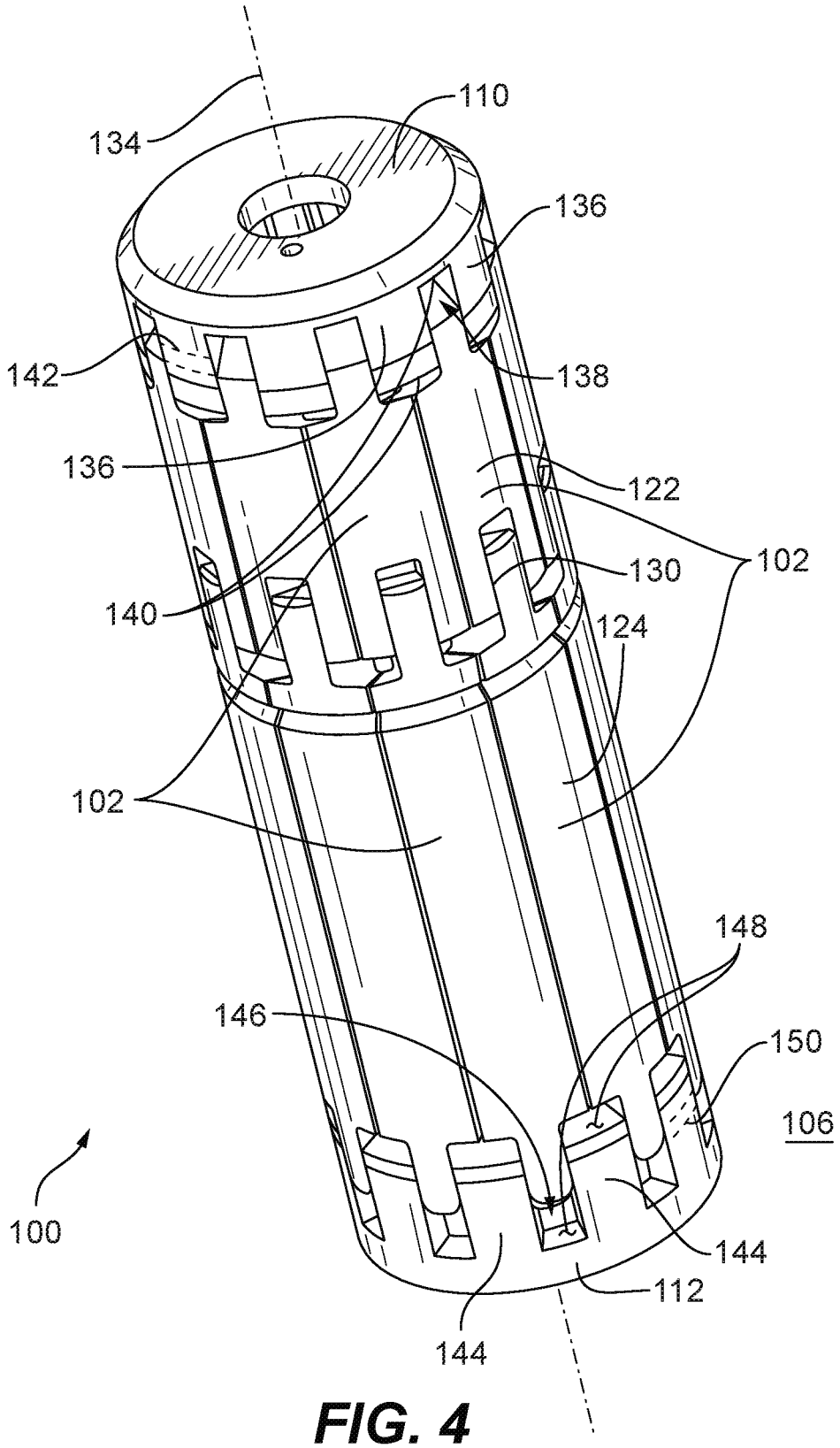
FIG. 4 is perspective view of the through-tubing bridge plug of FIG. 1 with the elastic barrier sleeve removed, showing the linkages of the through-tubing bridge plug extending in parallel relative to one another when the lower annulus is in the distal position.
Figure 5:
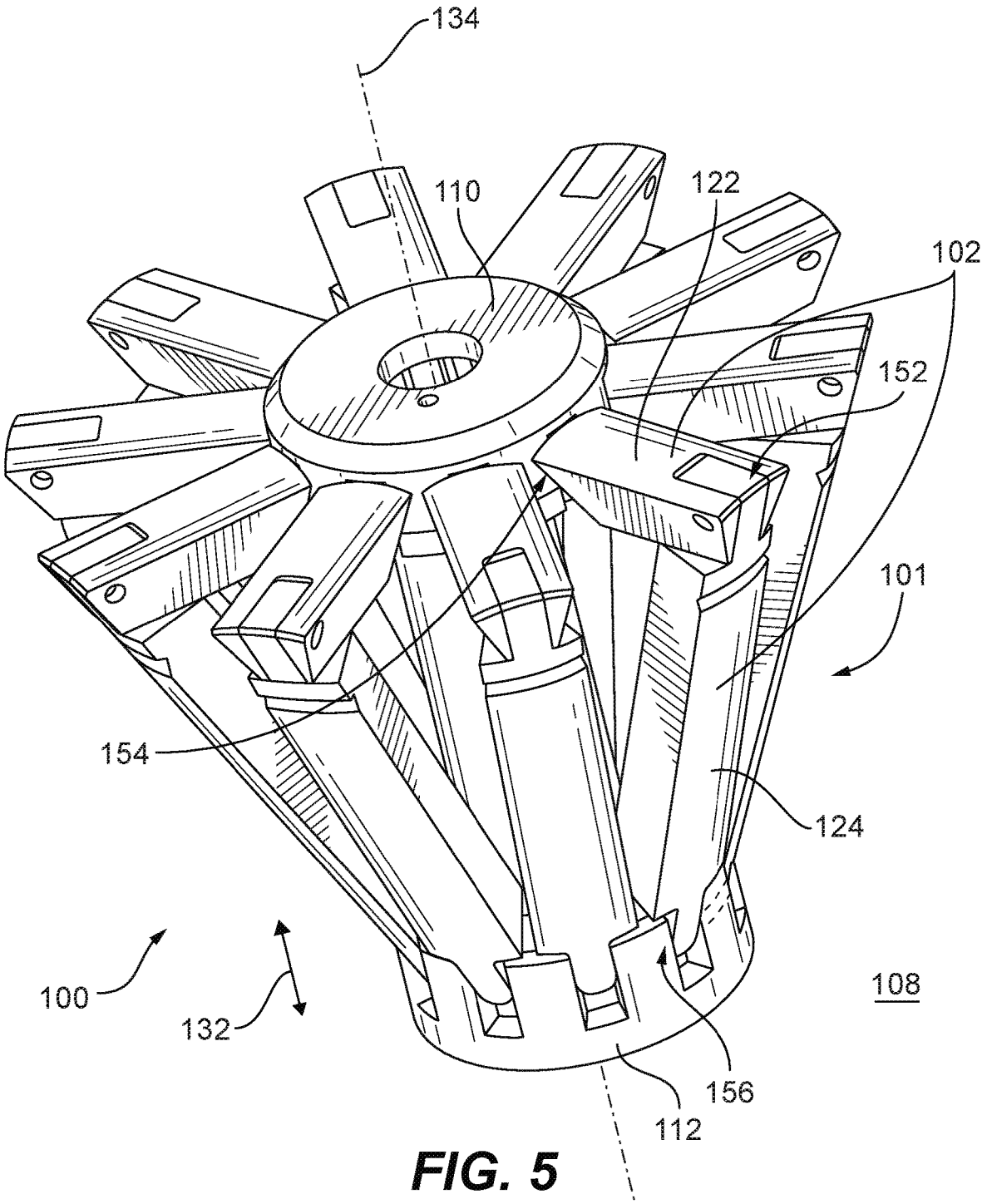
FIG. 5 is perspective view of the through-tubing bridge plug of FIG. 1 with the elastic barrier sleeve removed, showing the linkages splayed radially outward from the upper and lower annulus when the lower annulus is displaced to the proximate position.

With reference to FIGS. 4 and 5, splayable assembly 101 of bridge plug 100 is shown with elastic sleeve 104 removed. Referring to FIG. 4, splayable assembly 101 is shown with lower annulus 112 in distal position 106. Splayable assembly 101 includes upper annulus 110, lower annulus 112, and linkages 102. Upper annulus 110 and lower annulus 112 are each arranged along axis 134, lower annulus 112 being offset from upper annulus 110 in both distal position 106 and proximate position 108. Linkages 102 each include an upper link 122 connected to a lower link 124 by a joint 130, joint 130 pivotably connecting lower link 124 to upper link 122, upper link 122 and lower link 124 being configured to couple lower annulus 112 to upper annulus 110, respectively.

Upper annulus 110 extends about axis 134 and has a plurality of upper extensions 136. Upper extensions 136 are circumferentially distributed about axis 134, circumferentially adjacent upper extensions 136 each being separated by an upper gap 138. Upper extensions 136 and upper gaps 138 define an upper annulus face 140, which is oriented downward (relative to the top of FIG. 4) and which axially opposes lower annulus 112. Each upper extension 136 has receiving slot 142 at a radially inward location and opening to upper gaps 138 defined at circumferentially opposite sides of the respective upper extension 136 for pivotably seating a linkage 102 within upper gaps 138 located on upper gaps 138 circumferentially adjacent to the upper extension 136. It is contemplated that upper annulus 110 can be as described, for example, in U.S. Pat. No. 9,051,812 to Clemens et al., issued on Jun. 9, 2015, the contents of which is incorporated herein by reference in its entirety.

Lower annulus 112 is similar to upper annulus 110 with the difference that lower annulus 112 is inverted relative to upper annulus 110. In this respect lower annulus 112 extends about axis 134 and has a plurality of lower extensions 144. Lower extensions 144 are circumferentially distributed about lower annulus 112 and are spaced apart from one another by lower gaps 146. Lower extensions 144 and lower gaps 146 define a lower annulus face 148. Lower annulus face 148 opposes upper annulus face 140 along axis 134. Each lower extension 144 has a receiving slot 150 defined by the respective lower extension which is accessible from lower gaps 146 circumferentially separated from one another by the respective lower extension 144.

Each linkage 102 includes upper link 122 and lower link 124. On ends opposite upper annulus 110 and lower annulus 112 upper link 122 and lower link 124 pivotably connect to one another at link joint 130. Each upper link 122 is pivotably connected to upper annulus 110 by upper link pivot members 154, located on circumferentially opposite faces of each upper link 122, that pivotably seat in receiving lots 142 of upper extensions 136 on an end of the respective upper link 122 opposite link joint 152. Similarly, on ends opposite link joints 152, each lower link 124 is pivotably connected to lower annulus 112 by lower link pivot members 156, located on circumferentially opposite faces of each upper link 122, that pivotably seat within a receiving lots 142 of upper extensions 136.

In certain embodiments elastic barrier sleeve 104 extends about a joint 130 coupling upper link 122 to lower link 124 of each of the linkage 102. In accordance with certain embodiments resilient sleeve 104 can axially span upper link 122. It is also contemplated that elastic sleeve 104 can span upper link 122, lower link 124, upper link 122 and joint 130, lower link 122 and joint 130, or both upper link 122 and lower link 124 as well as joint 130. In the illustrated exemplary embodiment elastic sleeve extends circumferentially about each of upper link 122, lower link 124, and joint 130.

As shown in FIG. 5, displacement of lower annulus 112 relative to upper annulus 110 splays linkages 102 radially outward from upper annulus 112 and lower annulus 110. To move from distal position 106 (shown in FIG. 4) to proximate position 108 lower annulus 112 displaces towards upper annulus 110 along axis 134 via stroke 132. The upward displacement causes each upper link 122 and each lower link 124 to splay radially outwards relative to upper annulus 110 and lower annulus 112. The outward splay of each lower link 124 and upper link 122 deforms elastic sleeve 104 (shown in FIG. 1) radially outward, thereby causing a radially outer extreme of elastic sleeve be compressed between the interior surface of casing 20 and linkages 102. More particularly, matrix 126 (shown in FIG. 3) and elastomeric material 128 (shown in FIG. 3) gets radially compressed between the link joints 152 of the linkage 102 to define separation/isolation barrier 24.

As will be appreciated by those of skill in the art in view of the present disclosure, this limits the amount of resilient material forming separation/isolation barrier 24 and renders separation/isolation barrier 24 more tolerant of the relatively high temperatures that may be present within wellbore 10 by delaying the interval between emplacing bridge plug 100 and the time at which elastomeric material 128 may begin to flow. This can be particularly advantageous in cementing operations as it can increase the time that separation/isolation barrier 24 can support the cement while curing.

It is contemplated that upper link 122 be shorter than lower link 124. For example, the length of lower link 124 and the diameter of upper annulus 110 can be selected such that, when upper link 122 is splayed, upper link 122 extends radially outward and substantially in parallel with upper annulus 110. In certain embodiments the ratio of the lengths of upper link 122 and lower link 124 is selected such that the length of stroke 132 is about nine (9) inches (about 23 centimeters). Relatively short stroke lengths, such as that shown in the illustrated exemplary embodiment, can simplify positioning and setting bridge plug 100.

Figure 6:
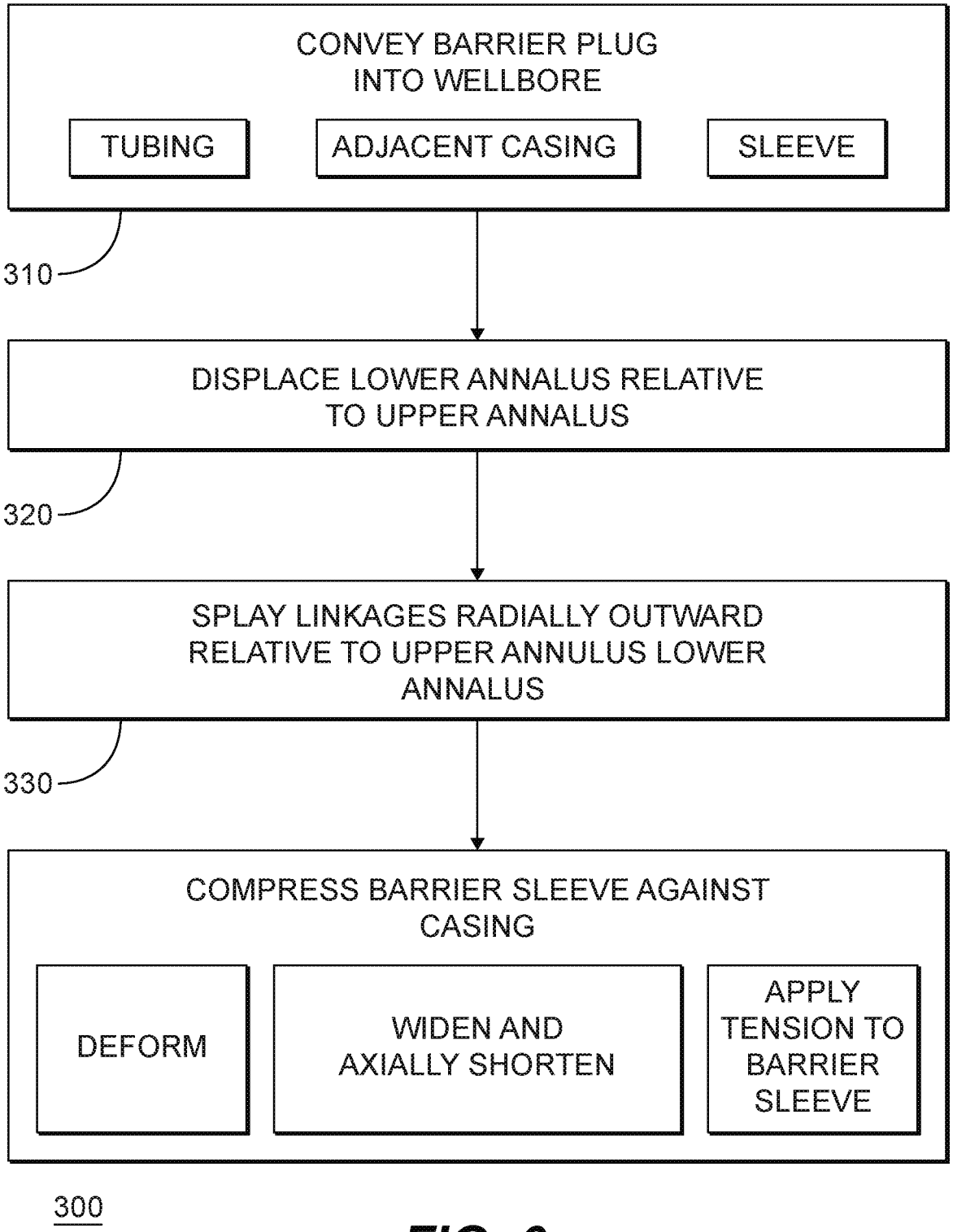
FIG. 6 is a block diagram of a method of emplacing a through-tubing bridge plug in a wellbore, showing steps of the method.

With reference to FIG. 6, a method 300 of placing a through-tubing bridge plug, e.g., bridge plug 100 (shown in FIG. 1), is shown. As shown with box 310, the through-tubing bridge plug is conveyed into a wellbore, e.g., wellbore 10 (shown in FIG. 1). Conveying the bridge plug into the wellbore can include conveying the bridge plug through tubing supported within the wellbore, e.g., tubing 20, as shown with box 312, as a through-tubing bridge plug. Conveying the bridge plug into the wellbore can include conveying the bridge plug to a location below the production tubing and adjacent to a casing fixed within the wellbore, e.g., casing 22 (shown in FIG. 1), as shown with box 314. The bridge plug can be conveyed into the wellbore using a slickline arrangement, e.g., slickline arrangement 200 (shown in FIG. 1), as shown with box 316.

Once suitably position within the wellbore a lower annulus of the bridge plug, e.g., lower annulus 112 (shown in FIG. 1), is displaced relative to an upper annulus, as shown with box 320. As the lower annulus is displaced towards the upper annulus linkages, e.g., linkages 102 (shown in FIG. 4), as splayed radially outward relative to the upper annulus and the lower annulus, as shown with box 330. Splaying the linkages can include splaying an upper link, e.g., upper link 122 (shown in FIG. 4), radially outward relative to the upper annulus, as shown with box 332. Splaying the linkages can include splaying a lower link, e.g., lower link 124 (shown in FIG. 4), radially outward relative to the lower annulus, as shown with box 334.

The splaying of the linkages compresses an elastic sleeve, e.g., elastic barrier sleeve 104 (shown in FIG. 1), between the casing the splayable assembly, as shown with box 340. Compressing the elastic barrier sleeve against the wellbore casing can include deforming the shape of the elastic barrier sleeve, e.g., from cylindrical shape 103 (shown in FIG. 1) to frusto-conical shape 105 (shown in FIG. 1), as shown with box 342. It is contemplated that the compressing the elastic barrier sleeve against the wellbore casing can include loading the elastic barrier sleeve in tension axially, e.g., with tension 107 (shown in FIG. 4), as shown with box 344.

In embodiments described herein bridge plugs include expandable sleeves impregnated with an elastomeric material overlaying a mechanical mechanism that cooperate to create a separation/isolation barrier within a wellbore. In accordance with certain embodiments the setting stroke of the bridge plug can be relatively small, e.g., on the order of about nine (9) inches. Setting strokes in this range can reduce the cost of manufacturing the bridge plug, provide bridge plugs with relatively short axial height, and allow the bridge plug to be set using a downhole electrical power generator (e.g., using a DPU® electrical power generator, available from the Halliburton Energy Services, Inc. of Houston, Tex.). While described herein in the context of being positioned using a slickline conveyance, it is contemplated that other conveyances can be employed to position and set the through-tubing bridge plug within the wellbore, such as relay conveyances by way of non-limiting example.

A bridge plug includes a splayable assembly and an elastic barrier sleeve. The splayable assembly includes an upper annulus with a plurality of upper extensions, a lower annulus with a plurality of lower extensions opposing the upper annulus along an axis extending between the upper annulus and the lower annulus, and two or more linkages connecting the lower annulus to the upper annulus. The linkage has an upper link pivotably connected to a lower link, the upper link pivotably connected between circumferentially adjacent upper extensions and the lower link pivotably connected between circumferentially adjacent lower extensions. The elastic barrier sleeve extends circumferentially about the splayable assembly and is configured such that movement of the lower annulus towards the upper annulus expands the elastic barrier sleeve, thereby forming a bridge plug within a wellbore.

In certain embodiments the upper extensions can each have a receiving slot. The upper link can have pivot members which are received within adjacent receiving slots to pivotably fix the upper link to the upper annulus. The lower extensions can each have a receiving slot. The lower link can have pivot members which are received within adjacent receiving slots to pivotably fix the lower link to the lower annulus. The upper link can be pivotably connected to the lower link by a linkage joint arranged axially between the upper link and the lower link.

In accordance with certain embodiments, one of the upper link and the lower link can be shorter than the other of the upper link and the lower link. The linkage can be one of a plurality of linkages each coupling the lower annulus to the upper annulus and distributed circumferentially about the axis. The splayable assembly can have ten (10) linkages coupling the lower annulus to the upper annulus and distributed circumferentially about the axis. The elastic barrier sleeve can extend circumferentially about the plurality of linkages. The elastic barrier sleeve can axially span the upper link and/or the lower link. The elastic barrier sleeve can include a matrix impregnated with an elastomeric material, such as a polymer or a rubber material.

It is contemplated that, in accordance with certain embodiments, the lower annulus can have a distal position and a proximate position relative to the upper annulus. In the distal position the linkage can be substantially parallel to the axis, the elastic barrier sleeve extending about the linkage. In the proximate position the linkage can be splayed radially outward from the upper and lower annulus such that the upper and lower links are oblique to the axis, the elastic barrier sleeve expanded by the splayed linkage. The elastic barrier sleeve can have a cylindrical shape, for example, when the lower annulus is in the distal position. The elastic sleeve can have a frusto-conical shape, for example, when the lower annulus is in the proximate position The lower annulus can be about nine (9) inches (23 centimeters) closer to the upper annulus in the proximate position that in the distal position.

A bridge plug arrangement includes a wellbore extending into a subterranean formation, a casing lining at least a portion of the wellbore, and a through-tubing bridge plug as described above. The bridge plug is disposed within the casing between an upper portion of the wellbore and a lower portion of the wellbore.

In certain embodiments the linkages can be splayed radially outward from the upper annulus and the lower annulus. The elastic barrier sleeve can be radially compressed between the casing and the splayable assembly when the linkage is splayed radially outward from the upper annulus and the lower annulus. The elastic barrier sleeve can carry a tensile load exerted by the linkage on the elastic barrier sleeve when the linkage is splayed radially outward from the upper annulus and the lower annulus. The bridge plug can be suspended within the wellbore by a slickline. The wellbore can include a production tube disposed at least partially within a casing, the bridge plug being configured as a through-tubing bridge plug for conveyance through the production tube and into the casing to form a barrier within the casing. The wellbore can be a mono-bore including only a casing, the bridge plug being configured for conveyance through the casing to form a barrier within the casing. The linkage can be substantially parallel to the axis extending between the lower annulus and the upper annulus when the lower annulus is in the distal position.

A method of placing a bridge plug as described above within a wellbore includes conveying the bridge plug into a wellbore. Once suitably positioned within the wellbore the lower annulus is displaced towards the upper annulus. Displacement of the lower annulus towards the upper annulus splays the upper link and the lower link radially outward from the lower annulus and the upper annulus. Splaying the upper link and lower link radially outward from the lower annulus and the upper annulus in turn compresses the elastic barrier sleeve radially between the splayable assembly and a casing lining the wellbore. In certain embodiments splaying the upper link and lower link radially outward from the lower annulus and the upper annulus loads the elastic barrier sleeve axially with a tensile load.

These and other features of the systems and methods of the subject disclosure will become more readily apparent to those skilled in the art from the following detailed description of the preferred embodiments taken in conjunction with the drawings.

The methods and systems of the present disclosure, as described above and shown in the drawings, provide for through-tubing bridge plugs with superior properties including the capability for the through-tubing bridge plug to be emplaced using slickline arrangements and conveyance methods. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A bridge plug, comprising:

a splayable assembly, comprising:

an upper annulus with a plurality of upper extensions;

a lower annulus with a plurality of lower extensions, the lower extension opposing the upper extensions along an axis extending between the upper and lower annulus; and a linkage connecting the lower annulus to the upper annulus, wherein the linkage has an upper link pivotably connected to a lower link, the upper link connected between circumferentially adjacent upper extensions, the lower link connected between circumferentially adjacent lower extensions; and an elastic barrier sleeve extending about the linkage configured such that movement of the lower annulus towards the upper annulus expands the elastic barrier sleeve to form a bridge plug within a wellbore, wherein the elastic barrier sleeve is configured to fluidly isolate an upper portion of the wellbore from a lower portion of the wellbore.

2. The bridge plug as recited in claim 1, wherein each of the upper extensions has a receiving slot, wherein the upper link has pivot members received within adjacent receiving slots pivotably fixing the upper link to the upper annulus.

3. The bridge plug as recited in claim 1, wherein each of the lower extensions has a receiving slot, wherein the lower link has pivot members received within adjacent receiving slots pivotably fixing the lower link to the lower annulus.

4. The bridge plug as recited in claim 1, wherein the upper link is pivotably connected to the lower link at a linkage joint arranged axially between the upper and lower links.

5. The bridge plug as recited in claim 1, wherein one of the upper link and the lower link is shorter than the other of the upper link and the lower link.

6. The bridge plug as recited in claim 1, wherein the splayable assembly has a plurality of linkages distributed circumferentially between the upper annulus and the lower annulus, the plurality of linkages coupling the lower annulus to the upper annulus.

7. The bridge plug as recited in claim 6, wherein the elastic barrier sleeve extends about the plurality of linkages.

8. The bridge plug as recited in claim 1, wherein the elastic barrier sleeve includes a matrix impregnated with an elastomeric material.

9. The bridge plug as recited in claim 8, wherein the elastic barrier sleeve spans lengths of the both the upper link and the lower link of each of the plurality of linkages.

10. The bridge plug as recited in claim 1, wherein the lower annulus has a proximate position and a distal position relative to the upper annulus, the upper link substantially parallel with the axis when the lower annulus is in the distal position, the upper link oblique relative to the axis when the lower annulus is in the proximate position.

11. The bridge plug as recited in claim 10, wherein the proximate position and distal positions are separated by about nine (9) inches (about 23 centimeters).

12. The bridge plug as recited in claim 1, wherein the elastic barrier sleeve has a cylindrical shape.

13. The bridge plug as recited in claim 1, wherein the elastic barrier sleeve has a frusto-conical shape.

14. A bridge plug arrangement, comprising:

a wellbore extending into a subterranean formation;

a casing lining at least a portion of the wellbore; and a bridge plug as recited in claim 1, wherein the bridge plug is disposed within the casing between upper and lower portions of the wellbore.

15. The bridge plug arrangement as recited in claim 14, wherein the linkage is splayed radially outward from the upper annulus and the lower annulus, wherein the elastic barrier sleeve is radially compressed between the casing the linkage splayed radially outward from the upper annulus and the lower annulus.

16. The bridge plug arrangement as recited in claim 15, wherein the elastic barrier sleeve is axially uncompressed.

17. The bridge plug arrangement as recited in claim 14, wherein the bridge plug is suspended within the wellbore by a slickline.

18. The bridge plug arrangement as recited in claim 14, wherein the linkage is substantially parallel to the axis extending between the lower annulus and the upper annulus.

19. A method of placing a bridge plug within a wellbore, comprising:

conveying a bridge plug into a wellbore, the bridge plug having an elastic barrier sleeve and a splayable assembly including an upper annulus with a plurality of upper extensions, a lower annulus with a plurality of lower extensions opposite the upper extensions, a linkage connecting the lower annulus to the upper annulus, the linkage having an upper link pivotably connected to a lower link, the upper link connected between circumferentially adjacent upper extensions, the lower link connected between circumferentially adjacent lower extensions, and the elastic barrier sleeve extending about the linkage;

displacing the lower annulus toward the upper annulus;

splaying the upper link and the lower link radially outward of the lower annulus and the upper annulus using the displacement of the lower annulus; and compressing the elastic barrier sleeve radially between the splayable assembly and a casing lining within the wellbore, wherein the elastic barrier sleeve fluidly isolates an upper portion of the wellbore from a lower portion of the wellbore.

20. The method as recited in claim 19, further comprising loading the elastic barrier sleeve axially with a tensile load.

* * * * *